United States Patent [19]

Brandl et al.

[11] Patent Number: 4,477,722

[45] Date of Patent: Oct. 16, 1984

[54] MONITORING EQUIPMENT WHICH SWIVELS INTO AND OUT OF A TRAVELING LINE

[75] Inventors: Harald Brandl; Reinhard Dolc, both of Donawitz; Klaus Kammerhofer, Leoben, all of Austria

[73] Assignee: voest-Alpine Aktiengesellschaft, Vienna, Austria

[21] Appl. No.: 328,394

[22] Filed: Dec. 7, 1981

[30] Foreign Application Priority Data

Dec. 16, 1980 [AT] Austria ..... 6133/80

[51] Int. Cl.[3] ..... G01V 9/04

[52] U.S. Cl. ..... 250/222.1; 250/223 R

[58] Field of Search ..... 250/221, 222.1, 223 R, 250/223 B, 561, 560

[56] References Cited

U.S. PATENT DOCUMENTS

| | | | |
|---|---|---|---|
| 3,795,402 | 3/1974 | Bolger et al. | 250/222.1 |
| 3,983,388 | 9/1976 | Gugliotta | 250/223 R |
| 4,107,539 | 8/1978 | Kirsch | 250/223 R |

*Primary Examiner*—David C. Nelms

*Attorney, Agent, or Firm*—Cushman, Darby & Cushman

[57] ABSTRACT

In monitoring rod or wire rolling mills it is useful to determine whether the rolling and cooling trains are free of obstacles. To that end a light source and an optoelectric sensor are swivelled into the traveling line of the goods to be rolled and after measurement they are swivelled out of the traveling line. The measured data are supplied to a control unit to which also detectors (30, 31) for the traveling goods arranged in front of the supply end and/or behind the discharge end of the rolling train are connected.

5 Claims, 3 Drawing Figures

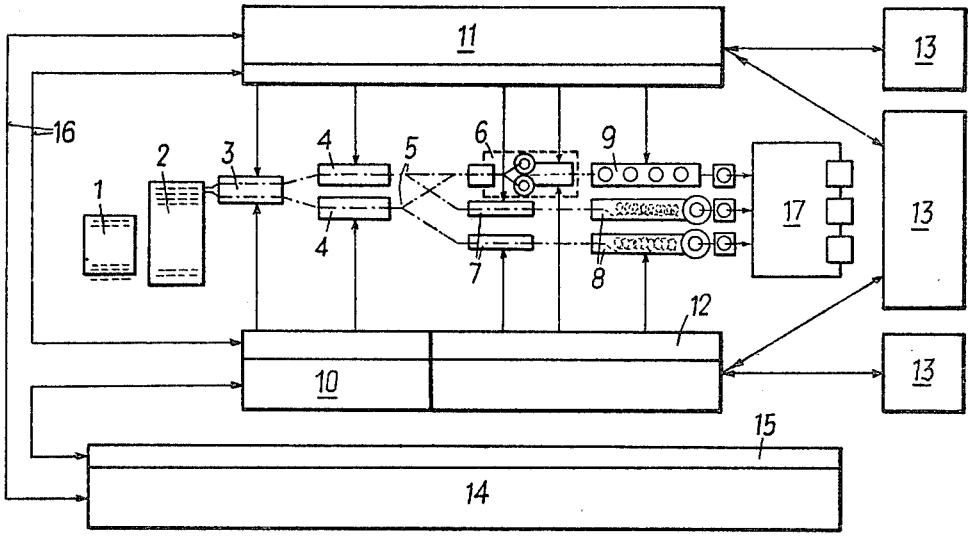
FIG. 1 PRIOR ART
FIG. 2
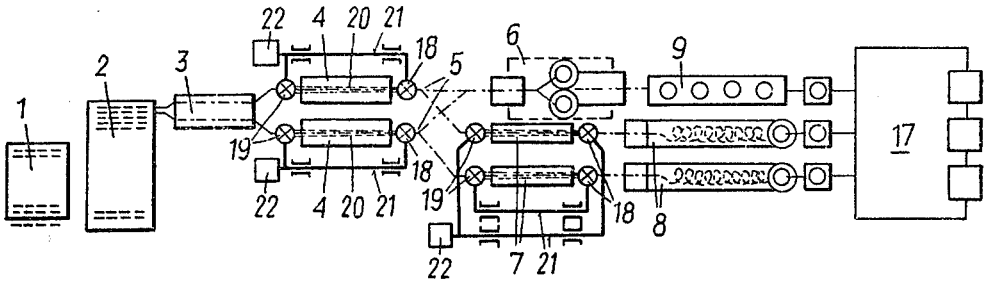
FIG. 3
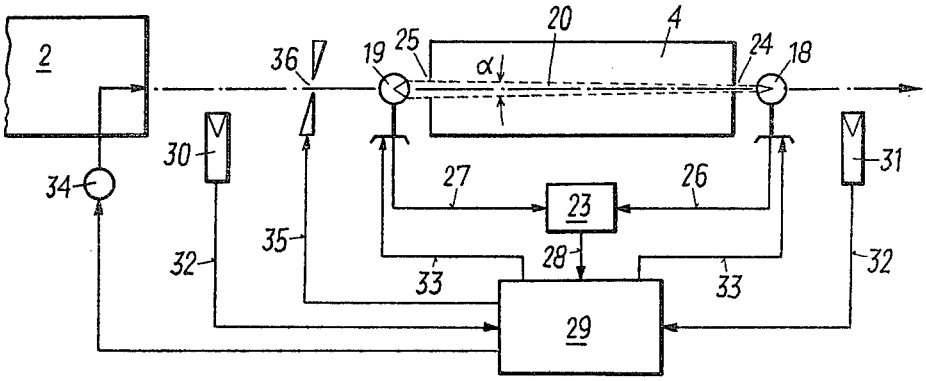

MONITORING EQUIPMENT WHICH SWIVELS INTO AND OUT OF A TRAVELING LINE

The invention refers to a monitoring equipment for rolling trains and cooling trains, particulary for the production of rods or wires. For increasing the throughput of partially of fully continuously operated rolling trains for producing elongated products such as profiles, rods or wires, such rolling mills are operated with increasing billet weight and increased rolling speeds. When working with rolling speeds of, for example, 30 to 80 m/s, a process control is provided because such rolling speeds are already too high for the reponsiveness of the operating personel. By means of known process controls, which are operated by using process computers, a number of operating parameters, which are essential for the rolling process, particulary the preselected rotation speed of the drive, the operation of the cutting aggregates of scissors, the formation of coils and the lauching of the rolled good is automatically supervised and controlled. Such computer-controlled rolling trains have, however, as a premise the absence of obstacles in the travelling line for the rolled good. If the travelling line for the rolled good is obstructed by obstacles such as residual material and deposits of the rolled good in the rolling trains and by water accumulation in the cooling trains, the incoming front end of the rolled good can with high operating speeds collide with parts of the equipment what may result in operating troubles, particulary in misrolled goods, which in its turn may cause the production of rejects and damaging of the rolling trains. The time expenditure required for removing such operation troubles results in a reduction of the utilization of the rolling trains. In view of the high dynamic stress generated by rods striking obstacles with high speed, rolling equipment and transport equipment can become damaged.

Existing rolling trains and cooling trains are, as a rule, checked for the absence of obstacles only if the rolling trains are adapted to the production of another rolled good or if rolling operation has already become disturbed. With known measures it is not possible to check the travelling line during rolling operation on account of the only short succession intervals of frequently less than 5 s for the individual pieces of rolled goods.

It is an object of the invention to provide an equipment of the initially mentioned type by means of which the travelling line can automatically be checked with the required accuracy within the time intervals existing between immediately succeeding rolling operations. For solving this task the invention essentially consists in that at least one light source, for example a Ne-He-Laser, is arranged at one end of the rolling train and the cooling train, respectively, for being swivelled into the travelling line and for being swivelled out of this travelling line, in that at least one photosensitive sensor, for example a Si-photo diode, is arranged at the other end of the rolling train and, respectively, the cooling train for being swivelled into the travelling line of the rolling material and for being swivelled out of this travelling line and in that the signals of the photosensitive sensor are supplied to an analyzing or interpreting circuit and to a control unit for the rolling train and, respectively, the cooling train. On account of optoelectronically checking the travelling line, the absence of obstacles can rapidly be checked during the relatively short time interval between succeeding rolling operations by means of process computers. For preventing any collision of the optoelectronic measuring equipment with the rolling good or rolling stock, the light source and the photosensible sensor each are pivotally arranged and can, for performing the measuring operation, be swivelled into the travelling line and, after having effected the measurement be swivelled out of the travelling line. The light source is, for example, a Ne-He-Laser having a power of $<10$ mW. Such a laser is essentially not influenced by the industrial atmosphere and can be focussed in a extremely precise manner. The photosensible sensor can, for example, be a Si-photo diode having a short response time of for example $10^{-2}$ s. The signals of the photosensible sensor can be interpreted by the process computer provided for controlling the process or by a separated analyzing or interpreting circuit and be used for controlling the drive equipment.

For determining the suitable moment for swivelling the light source and the photosensible sensor into the travelling line, there is preferably provided at least one additional detector for the rolled material, for example a photocell, a light barrier or an inductive or capacitive proximity switch, prior to the supply end and/or behind the discharge end of the rolling train or cooling train to be monitored, noting that the control means can be connected with a drive means for swivelling the light source and the sensor. With such an arrangement, the various possible operating troubles can be recognized in time and the required control measure can equally be made effective in time. If, for example, the result of measuring the travelling line says that no obstacle is present, no additional control measures are required. In case that an obstacle has been recognized in the travelling line, supply of further blanks can be stopped until the obstacle has been removed under the condition that the blanks have not yet been supplied into the production line. If, however, the additional detector for rolling material signalizes that the blanks have already been supplied into the production line, the control means can, for example, give a command for removing the obstacles as far as there is still sufficient time. If there is a replacement product path, a collision of the material having entered the production line could be avoided by switching over a diverter. If there is no such path, so that such measures for preventing a collision would be belated, there exists still the last possibility to activate a cutting means so that the rolling good is removed from the rolling train prior to its impact onto the obstacle. For this purpose, the arrangement is preferably such that the control means is in a manner known per se connected with the drive means for the rolling train or, respectively, the cooling train and/or with at least one parting device such as a chopping machine and/or with at least one diverter leading to a replacement product path in front of the supply end of the rolling train or cooling train to be monitored.

In an advantageous manner, the light source is arranged at the discharge end of the rolling train to be monitored so that there is provided the possibility to focus the radiation cone of the light source in correspondence with the pass line of the rolling train. Such focussing of the light source provides the greatest reliability for recognizing of obstacles within the rolling train and the cooling train, respectively.

In the following the invention is further illustrated with reference to the drawings showing an embodiment of the invention.

IN THE DRAWING

FIG. 1 shows a block diagram of a usual computer-controlled rolling train,

FIG. 2 is a detail of FIG. 1 in an enlarged scale and showing a monitoring equipment according to the invention and FIG. 3 shows a further embodiment of the monitoring equipment according to the invention.

In FIG. 1, reference numeral 1 designates the supply station for the billets. Reference numeral 2 represents a walking-beam heating furnace which can be used as a buffer station for the blanks. Reference numeral 3 designates a twin-strand cogging train which is followed by intermediate trains 4. Down stream of the intermediate trains 4 there are provided diverters 5 for distributing the rolling stock. Reference numeral 6 designates Garrett capstans, while the finishing trains 7 are feeding the roll stock to coilers 8 for forming coils. Reference numeral 9 designates a transport means for coils. The process control means is schematically shown in FIG. 1 in which reference numeral 10 designates a command calculator for the first train and reference numeral 11 designates a command calculator for the second train. In additon, there is provided a corresponding peripheral device 13. In addition, there is included into the process control a material tracking calculator 14 and a peripheral device 15 associated therewith. Reference numeral 16 designates coupling conduits for connecting the individual calculators and, respectively, peripheral devices.

Into such a plant, the monitoring equipment is incorporated as is shown in FIG. 2. Constructional parts remaining unchanged as compared with FIG. 1 are given the same reference numerals, noting that in the enlarged representation there is also shown a hook trolley 17 for transporting the coils to testing, pressing, binding, assorting and discharging.

The monitoring equipment has a measuring equipment consisting of a light source 18 and of a photosensitive sensor 19. The light source 18 is formed of a Ne-He-Laser and the photosensible sensor is formed of a Si-photodiode. Transmitter and receiver 18 and, respectively, 19 are arranged for swivelling movement around an axis 21 located outside of the respective travelling line 20.

An enlarged representation of such a monitoring equipment is shown in FIG. 3. The Ne-He-Laser 18 is focussed to a divergency $\alpha$ of $<0{,}08$ mRad, that angle $\alpha$ corresponding to the sequence of passes of the rolling train 4. In the representation of FIG. 3, the transmitter 18 as well as the receiver 19 is swivelled into the travelling line 20 and the signal emitted by the laser is supplied to an interpreting or analyzing circuit 23 by the Si-photo diode 19. In dependence on whether the transmitter is arranged at the discharge end 24 of the rolling train 4 or at the supply end 25 of the same rolling train 4, the signal is fed to the interpreting or analyzing circuit 23 via a conduit 26 or a conduit 27. The interpreting or analyzing circuit 23 is connected with the central control unit 29 via a conduit 28. A detector 30 for the material to be rolled is arranged in front of the supply end 25. The detector for the rolled good, which is arranged at the discharge end 24, is designated 31, the signals of said detectors 30,31 being supplied to the central control unit 29 via conduits 32.

The pivotal drive 22 of the transmitter and of the receiver, respectively, is actuated by the central control unit 29 via conduits 33. If the detector 30 indicated that the rearward end of the rod has passed the area of this detector, pivotal movement of the receiver 19 into the travelling line 20 can be initiated after lapse of a corresponding safety time. Simultaneously one can start with supervising the following rod. If now also the detector 31 signalizes that the rearward end of the rod has passed, the transmitter 18 is swivelled into the travelling line 20 by the central control unit 29. Subsequently, the correspondingly focussed signal is emitted and the interpretation is started. Immediately after the measuring process the transmitter 18 and the receiver 19 are swivelled back into their starting position and thus out of the travelling line 20.

If the interpreting or analyzing circuit 23 signalizes that the travelling line is free, supply of the next blank is initiated and an interlock, if desired actuated at an earlier moment, is released again via the central control unit and a control means for the supply means 34.

If the travelling line is blocked, the control means 34 for the blank remains blocked on account of a command of the interpreting or analyzing circuit 23 of the central control unit 29 until the obstacle has been removed. If at this moment there exists already a signal of the detector 33, this does mean that the following rolling blank has already entered the supply end. Under the conditions shown in FIG. 3, no replacement path is at disposal and it seems already too late to remove the obstacle. In this case, a chopping machine 36 is actuated via the central control unit 29 and the control conduit 35, said chopping machine cutting the rolled good to pieces prior to striking the obstacle and removing the rolled good out of the rolling train. Such a measure can be omitted if a diverter provides the possibility to change over to a replacement path or if the obstacle can be removed in time.

The laser used is calibrated with empty rolling train. In operation the rolling train is assumed to be free of obstacles if at least 90% of the emitted beam intensity are received.

The control measures can be processed in a hard-wired calculator. The control measures can also freely be programmed, which provides higher flexibility, if, for example, the production plant is changed or if further control measures shall be taken into consideration.

In the embodiment shown in FIG. 2, the monitoring equipment is only provided for the intermediate trains and for the finishing trains. In the cogging train 3 which is operated with greater cross-sections, control measures are not imperative. The line of succeeding rolling trains can be cleared for each train separately or also in combination. If the rolling trains are immediately following one the other, the rolling trains can in practise only simultaneously be cleared.

In dependence on the beam power of the transmitter, rolling trains having a length up to 300 m can easily be monitored. When using a Ne-He-Laser there results beside the advantage of precise focussing of the beam the advantage that such a transmitter is not influenced by the industrial atmosphere, for example by oil fog or steam, and is also not influenced by ambient light.

What is claimed is:

1. Monitoring equipment for material being processed as it moves along a traveling line having a supply end and a discharge end and including a drive means, said equipment comprising opto-electric sensors which are connected to an interpreting circuit and to a control unit for the traveling line characterized in that at least one light source is arranged at one end of the traveling line for being swivelled into and out of the travelling line in that at least one photosensitive sensor is arranged at the other end of the traveling line for being swivelled into and out of the travelling line, in that the light source and the sensor are connected with a pivotal drive for swivelling them into and out of the traveling line, in that at least one additional detector for the material to be processed is arranged at one end of the traveling line, the signals of said detector being supplied to a control unit which is in connection with said pivotal drive.

2. Monitoring equipment as claimed in claim 1 characterized in that the control unit is connected with the drive means of the traveling line so as to stop said drive means when an obstacle in the traveling line has been detected.

3. Monitoring equipment as claimed in claim 1 characterized in that the light source is arranged at the discharge end of the traveling line.

4. Monitoring equipment as claimed in claim 1 characterized in that the control unit is in connection with devices for the removal of obstacles so as to remove obstacles when their presence is detected.

5. In a plant which includes a traveling line along which goods move from a supply end to a discharge end of the line and means for supplying goods at short time intervals to the supply end of the line: a monitoring system for determining whether the line is free of obstacles during the periods between operation of the supply means comprising a light source at one end of the line and a light sensor at the other end of the line; means for moving said source and said sensor into and out of the line, the arrangement being such that when said source and said sensor are in the line light from said source passes along the line to said sensor; and control means responsive to passage of goods to the supply end of the line and passage of goods from the discharge end of the line for moving said source and said sensor into the line.

* * * * *